US009675187B2

(12) United States Patent
Pizano

(10) Patent No.: US 9,675,187 B2
(45) Date of Patent: Jun. 13, 2017

(54) SHOE DISPLAY/STORAGE DEVICE

(71) Applicant: Marcello Raymond Pizano, San Jose, CA (US)

(72) Inventor: Marcello Raymond Pizano, San Jose, CA (US)

( * ) Notice: Subject to any disclaimer, the term of this patent is extended or adjusted under 35 U.S.C. 154(b) by 0 days.

(21) Appl. No.: 14/914,615

(22) PCT Filed: Sep. 3, 2014

(86) PCT No.: PCT/US2014/053763

§ 371 (c)(1),
(2) Date: Feb. 25, 2016

(87) PCT Pub. No.: WO2015/034848

PCT Pub. Date: Mar. 12, 2015

(65) Prior Publication Data

US 2016/0213170 A1 Jul. 28, 2016

Related U.S. Application Data

(60) Provisional application No. 61/873,172, filed on Sep. 3, 2013.

(51) Int. Cl.

| | |
|---|---|
| ***A47F 7/08*** | (2006.01) |
| ***A47F 5/08*** | (2006.01) |
| ***A47F 5/00*** | (2006.01) |
| ***A47F 5/02*** | (2006.01) |
| ***A47G 25/00*** | (2006.01) |
| ***A47F 7/14*** | (2006.01) |
| ***A47B 61/04*** | (2006.01) |

(52) U.S. Cl.

CPC ..... *A47F 7/08* (2013.01); *A47B 61/04* (2013.01); *A47F 5/02* (2013.01); *A47F 5/0815* (2013.01); *A47F 5/0823* (2013.01); *A47F 7/143* (2013.01); *A47G 25/005* (2013.01)

(58) Field of Classification Search

CPC .. A47F 7/08; A47F 5/02; A47F 5/0815; A47F 5/0823; A47F 5/0876; A47F 5/0884; A47F 3/10; A47F 5/0331; A47F 5/0037; A47F 2005/0075; A47F 7/021; A47F 7/143; A47B 61/04; A47B 2063/005; A47B 49/00; A47G 25/005; A47G 25/06; E05B 69/003

USPC ..... 211/30, 34, 35, 37, 57.1, 59.1, 106.01, 211/163, 165, 85.1, 85.3; 248/220.31, 248/220.41, 220.42, 220.43

See application file for complete search history.

(56) References Cited

U.S. PATENT DOCUMENTS 2,536,027 A * 1/1951 Braswell ..... A47F 13/04 211/163
2,868,386 A * 1/1959 Seyforth ..... A47F 5/02 211/183
2,872,145 A * 2/1959 Goldsholl ..... A47F 5/0823 248/220.42

(Continued)

*Primary Examiner* — Jennifer E Novosad
(74) *Attorney, Agent, or Firm* — Jill A. Jocobson

(57) ABSTRACT

A rotatable device for displaying and storing shoes or other items of interest is provided. The device includes a base, a vertical column, and a housing that is attached to the column, with openings for suspension of shoes or other items on the outside of the housing. Alternatively, the display device may be in the form of a display board that is attached to a frame.

22 Claims, 7 Drawing Sheets

(56) References Cited

U.S. PATENT DOCUMENTS 2,941,669 A * 6/1960 Palay ..... A47B 96/1425 211/1.55
2,973,867 A 3/1961 Cohen
3,002,629 A * 10/1961 Gersin ..... A47F 5/0823 211/35
3,080,067 A * 3/1963 Lind ..... A47F 5/04 211/190
3,195,731 A * 7/1965 Bomar, Jr. ..... A47F 7/021 211/85.1
3,243,047 A * 3/1966 Witteborg ..... A47F 7/148 211/163
3,292,797 A * 12/1966 Berk ..... A47F 5/02 211/163
3,478,890 A * 11/1969 Allsop ..... A43D 3/1425 211/163
3,502,226 A * 3/1970 Marschak ..... A47F 5/02 211/163
3,502,294 A * 3/1970 Kalbow ..... A47F 5/0025 211/41.2
3,693,807 A * 9/1972 Larson ..... A47F 5/02 211/163
3,739,919 A * 6/1973 Hochman ..... A47F 5/0815 211/194
4,036,367 A 7/1977 Stambaugh et al.
4,157,760 A * 6/1979 Wilson ..... A47F 7/021 211/163
4,211,331 A * 7/1980 Salmon ..... A47F 5/02 211/163
4,258,962 A * 3/1981 Slaugh ..... B25H 3/00 280/79.2
4,480,755 A * 11/1984 Cartwright ..... A47F 5/02 211/163
5,026,011 A * 6/1991 Hoefkes ..... A47F 5/0823 248/220.41
5,050,746 A * 9/1991 Frankel ..... A47F 7/08 211/163
5,054,624 A * 10/1991 Camp ..... A47F 7/02 211/163
5,064,077 A * 11/1991 Mitchell ..... A47F 7/0028 211/13.1
5,112,014 A * 5/1992 Nichols ..... A47F 5/0823 248/220.42
5,118,176 A * 6/1992 Motley, Sr. ..... A47F 7/08 160/237
5,127,528 A * 7/1992 Cone ..... A47B 96/1425 211/163
5,228,582 A * 7/1993 Marshall ..... A47F 5/02 206/338
5,257,703 A * 11/1993 Ascik ..... A47F 7/021 211/166
5,346,167 A * 9/1994 Smialek ..... A47F 5/0823 248/220.43
5,379,976 A * 1/1995 DeGirolamo ..... B25H 3/04 248/220.43
5,505,319 A * 4/1996 Todd, Jr. ..... A47F 5/04 211/163
5,535,895 A * 7/1996 Valiulis ..... A47F 5/02 211/163
5,636,751 A * 6/1997 Frank ..... A47B 61/04 211/163
5,785,185 A 7/1998 Klebba
6,036,311 A * 3/2000 Friedman ..... A47F 5/02 351/158
6,119,871 A * 9/2000 Mengel ..... A47F 7/08 211/117
6,206,208 B1 * 3/2001 Dennig ..... A47F 7/02 211/85.2
6,443,317 B1 * 9/2002 Brozak, Jr. ..... A47F 7/021 211/85.1
6,502,707 B1 1/2003 Sullivan
6,505,749 B1 * 1/2003 Panetta ..... A47B 96/025 211/163
6,966,446 B1 * 11/2005 Wise ..... A47F 5/0006 206/806
2006/0081548 A1 * 4/2006 Babbino ..... A47F 5/02 211/85.1
2010/0155553 A1 * 6/2010 Langley ..... A47F 5/0823 248/220.43
2016/0213170 A1 * 7/2016 Pizano ..... A47F 7/08

* cited by examiner

SHOE DISPLAY/STORAGE DEVICE

CROSS-REFERENCE TO RELATED APPLICATIONS

This application is a U.S. national stage application under 35 U.S.C. §371 of PCT Application No. PCT/US2014/053763, filed on Sep. 3, 2014, and claims the benefit of U.S. Provisional Application No. 61/873,172, filed on Sep. 3, 2013, which is incorporated herein by reference in its entirety.

FIELD OF THE INVENTION

The invention relates to a rotatable device for supporting and displaying shoes or other items.

BACKGROUND

Storage and retrieval of multiple pairs of shoes presents an obstacle in homes in which closet space is at a premium. In residential homes, shoes are often stored in closets. When an individual owns too many pairs of shoes to display in a closet, they may be left in boxes and stored on the floor or shelves or under a bed, where they cannot be easily viewed or retrieved.

Commercially available shoe racks include stackable shelves or bins or vertical racks or cabinets that can take up a considerable amount of floor or vertical space in a closet while storing a relatively small number of shoes. Under the bed shoe organizers are also available, but they are cumbersome to pull in and out of the small space under a bed and have the additional disadvantage that shoes can only be viewed when the entire unit is retrieved from its otherwise unviewable location. Other commercial devices include units that fit over a door, which may become heavy or bump into the door when opened or closed, and devices with separately rotatable shelves or racks, which require rotation of each shelf by hand to access a particular pair of shoes.

A device which takes up minimal floor or closet space while allowing for display and easy access to numerous pairs of shoes would be desirable.

BRIEF SUMMARY OF THE INVENTION

Devices for storing and displaying a plurality of items such as shoes, clothing or jewelry accessories, tools, etc. are provided.

In one aspect, a rotatable device is provided, e.g., for displaying and/or storing shoes, e.g. a plurality of different shoes or pairs of shoes. The device includes: (a) a base; (b) a column that is vertically or substantially vertically oriented and supported on the base; (c) a housing that is attached to and rotatably disposed about the column, wherein the housing includes an outer surface that faces the outside of the housing and an inner surface that faces the inside of the housing; and (d) a plurality of openings that extend from the outer surface to the inner surface of the housing.

In some embodiments, the device further includes a sheath (e.g., a hollow tubular member) that is interior to the housing and that includes a proximal end that is attached to the base and a distal end that extends vertically or substantially vertically a first portion of the height of the housing from the base. The sheath (e.g., tubular member) includes an interior diameter than is greater than the exterior diameter of the column. The column includes a proximal end that is inserted into the sheath (e.g., tubular member) and extends downward toward the base and a distal end that extends vertically or substantially vertically a second portion of the height of the housing, toward the top of the housing. In some embodiments, the second portion is greater than the first portion.

In some embodiments, the device further includes a structural member that is interior to the housing and which includes an opening through which the column extends, wherein the diameter of the opening in the structural member is smaller than the exterior diameter of the sheath (e.g., hollow tubular member). The structural member rests on top of the distal end of the sheath (e.g., tubular member). In some embodiments, the structural member may be attached at its periphery to the housing. In some embodiments, the structural member is a disc or disc-like structure with an opening in the center through which the column extends, but of a diameter small enough such that the disc or disc-like structure rests on top of the sheath (e.g., tubular member). In some embodiments, the disc or disc-like structure is a solid disc with one opening in the center through which the column extends.

In some embodiments, the openings in the housing are spaced apart and of a dimension sufficient to accommodate at least a portion of a heel of a shoe (e.g., a "high-heeled" shoe) to extend through the opening. A shoe may be retained on the housing in a vertical or substantially vertical orientation with at least a portion of the heel of the shoe extending beyond the inner surface into the interior of the housing.

In some embodiments, the openings in the housing are spaced apart and of a dimension sufficient to accommodate ends of brackets to extend through the openings. The brackets may be of a dimension sufficient to slidably accommodate a shoe (e.g., a flat or low-heeled shoe or sandal) without permitting the shoe to slide completely through the bracket. A shoe may be retained by a bracket on the outer surface of the housing in a vertical or substantially vertical orientation. A portion of a bracket may protrude from the outer surface of the wall of the housing to a dimension that is sufficient to slidably retain a shoe. The end portions of brackets may be retained on the inner surface of the housing. In one embodiment, the bracket may include a fastening portion at each end to fasten the bracket to the inner surface of the wall of the housing. In one embodiment, the bracket includes two end portions that are retained on the inner surface of the wall of the housing, with the weight of the shoe providing a downward pressure on the bracket, wherein the downward pressure anchors the ends of the bracket on the inner surface of the housing.

In some embodiments, the device includes (i) openings that are spaced apart and of a dimension sufficient to accommodate at least a portion of a heel of a shoe to extend therethrough, wherein the shoe is retained on the housing in a vertical or substantially vertical orientation with at least a portion of the heel of the shoe extending beyond the inner surface into the interior of the housing; and (ii) openings that are spaced apart and of a dimension sufficient to accommodate ends of brackets to extend therethrough, wherein the brackets are of a dimension sufficient to slidably accommodate a shoe without permitting the shoe to slide completely through the bracket, wherein the shoe is retained on the outer surface of the housing in a vertical or substantially vertical orientation.

In some embodiments, the device includes grommets and/or a beveled edge around at least a portion of the interior of the openings in the housing.

In some embodiments, the device includes a mechanism, such as knobs, handles, or the like, on the outer surface of the cylinder, to facilitate rotating the cylinder manually. In some embodiments, the device includes an electrical, hydraulic, or battery powered mechanism to facilitate rotating the cylinder.

In some embodiments, the device may include one or more extension located above the housing. An extension may be attached to and rotatably disposed about the column, or may be attached to the top of the housing or attached to the top of another extension. In some embodiments, the extension is slidably inserted into the top of the housing. In some embodiments, an extension includes an outer surface that faces the outside of the extension and an inner surface that faces the inside of the extension, and includes a plurality of openings that extend from the outer surface to the inner surface of the extension. In some embodiments, the extension is in the form of a cap, e.g., a hemi-spherical or substantially hemi-spherical cap, above the housing.

In some embodiments, the openings in the extension are spaced apart and of a dimension sufficient to accommodate an accessory to extend through the opening with a portion of the accessory extending beyond the inner surface into the interior of the extension. In one embodiment, the accessory is a pair of eyeglasses or sunglasses, and the openings are spaced apart and of a dimension sufficient to accommodate at least a portion of each temple and/or earpiece of the eyeglasses or sunglasses.

In some embodiments, the openings in the extension are spaced apart and of a dimension sufficient to accommodate ends of brackets or clips that extend though the openings and that are suitable to retain accessories on the outer surface of the extension, with the ends of the brackets or clips retained on the inner surface of the housing. Accessories which may be retained by the brackets or clips on the outer surface of the extension include, but are not limited to, hats, jewelry, scarves, ties, bowties, belts, collectable miniature shoes, or the like.

In some embodiments, an extension includes a mechanism, such as knobs, handles, or the like, on the outer surface of the extension, to facilitate rotating the extension manually. In some embodiments, the extension includes an electrical, hydraulic, or battery powered mechanism to facilitate rotating the extension.

In some embodiments, the rotatable device and an extension are separately rotatable. In other embodiments, the rotatable device and an extension are not separately rotatable.

In some embodiments, the rotatable device is adapted for displaying and/or storing small accessory items, such as jewelry, e.g., earrings, necklaces, rings, bracelets, or the like. Brackets or clips to hold the accessory items extend through openings that extend from the outer surface to the outer surface of the housing of the device, with ends of brackets or clips retained on the inner surface of the housing. The dimensions of the device may be adapted such that the device may sit on the top of a bureau, dressing, table, or the like.

In some embodiments, the rotatable device is adapted for displaying and/or storing tools, such as hammers, screwdrivers, pliers, gardening tools, or the like. Brackets or clips to hold the tools extend through openings that extend from the outer surface to the inner surface of the housing of the device, with ends of brackets or clips retained on the inner surface of the housing. The device may sit on the floor, e.g., the floor of a work area, workshop, or garage, or the dimensions of the device may be adapted such that the device may sit on the top of a work surface such as a workbench or the like.

In another aspect, a bracket is provided for retaining an object, such as a shoe, accessory, tool, garden implement, etc. against a wall or device having an outer surface and an inner surface. The bracket includes two first sections that include the ends of the brackets, two second sections that are contiguous with the first sections at one end and contiguous with a third, inner section of the bracket at the other ends. The angle between the first sections and the second sections may be approximately 90°. The angle between the second sections and the third, inner section may be approximately 90°. The second sections provide a depth for retaining the object on the outer surface of the wall or device. The third section provides a width for retaining the object on the outer surface of the wall or device. The first sections are of a length suitable for holding the object in a vertical or substantially vertical orientation against the outer surface of the wall or device. The ends of the first sections are held against the inner surface of the wall or device by downward pressure exerted by the object as it is slidably inserted into the bracket on the outer surface of the wall or device. In some embodiments, the object is a flat or short-heeled shoe or sandal.

In another aspect, a display board is provided for displaying shoes. The display board includes an outer surface and an inner surface. The board may be attached to a wall or other vertical or substantially vertical surface with the inner surface of the board facing the wall or other surface. In some embodiments, the display board may be mounted on a frame, which may be attached to a wall or other vertical or substantially vertical surface, with the inner surface of the board facing the wall or other surface. In some embodiments, the display board includes at least one horizontal or substantially horizontal row of first openings that include a first diameter and at least one horizontal or substantially horizontal row of second openings that include a second diameter, wherein the first diameter is larger than the second diameter. In some embodiments, the first openings are spaced apart and of a dimension sufficient to accommodate at least a portion of a heel of a shoe (e.g., a "high-heeled" shoe) to extend therethrough, wherein the shoe is retained on the outer surface of the display board in a vertical or substantially vertical orientation with at least a portion of the heel of the shoe extending beyond the inner surface of the display board. In some embodiments, the second openings are spaced apart and of a dimension sufficient to accommodate the ends of brackets to extend therethrough, wherein the brackets are of a dimension sufficient to slidably accommodate a shoe (e.g., a flat or low-heeled shoe or sandal) without permitting the shoe to slide completely through the bracket, wherein the shoe is retained on the outer surface of the display board in a vertical or substantially vertical orientation. In one embodiment, the display board includes one row of first openings and two rows of second openings below and/or above the row of first openings. In some embodiments, the display row includes a repeating pattern of one row of first openings above and/or below two rows of the second openings.

BRIEF DESCRIPTION OF THE DRAWINGS

The drawings herein are for illustration purposes and are not necessarily drawn to scale.

FIG. 6 shows an exemplary embodiment of the base, vertical column, sheath (e.g., tubular member) into which the column is inserted, and interior supporting structure of a rotatable device as described herein. The housing, optional accessory cap, and interior structures through which the column extends and which are attached to the housing are shown in dashed lines.

FIG. 7 shows an exemplary embodiment of a pattern of openings in the housing of a rotatable display device as described herein or a display board.

DETAILED DESCRIPTION

A rotatable device for storing and/or displaying shoes or other objects is provided. A device as described herein includes a base, a column supported on the base, and a housing that is attached to and is configured to rotate about the column.

In some embodiments, the column is supported on the base by insertion into a sheath (e.g., a hollow tubular member) into which the column fits that is attached at one end to the base and that extends upwardly. The diameter of the sheath (e.g., hollow tubular member) is larger than the diameter of the column and of a dimension such that the column may be slidably inserted into the interior of the sheath (e.g., tubular member). The bottom of the column may rest on the base or on an interior support portion within the sheath (e.g., tubular member). Optionally, a knob, screw, or the like, may be provided that may be tightened from the outside of the sheath (e.g., hollow tubular member) to secure the column.

In some embodiments, a horizontal or substantially horizontal disc or disc-like structure, through which the vertical column extends, is supported on the top of the sheath (e.g., hollow tubular member) and attached at its periphery to the housing. The disc or disc-like structure contains an opening in the center through which the column extends. One or more additional horizontal or substantially horizontal discs or disc-like structures, through which the vertical column extends, may be spaced at appropriate intervals interior to and attached at their peripheries to the housing, to provide additional support and structural integrity to the device. The interior disc or disc-like structure may be constructed of a solid material such as wood, plastic, or the like, or may contain open interior spaces, for example, spokes that radiate outward from the interior opening through which the column extents toward the periphery of the disc, where they may be attached to the interior of the housing. The disc or disc-like structure may be attached at its outer periphery to the housing with bolts, screws, rivets, or other suitable attachment means.

Openings are provided in the housing to support objects whereby one or more portion(s) of the object extends through one or more opening(s) into the interior of the housing with a portion of the object displayed on the outside of the housing, and/or ends of brackets that extend through openings into the interior of the housing with a center portion of the bracket protruding on the outside of the housing and of a dimension suitable for holding and displaying an object on the outside of the housing.

In some embodiments, the base may be free-standing (i.e., unattached to the floor or other surface), permitting the device to be movable from one location to another. In other embodiments, the base may be stationary and mounted to the floor or other surface.

Figure 1:
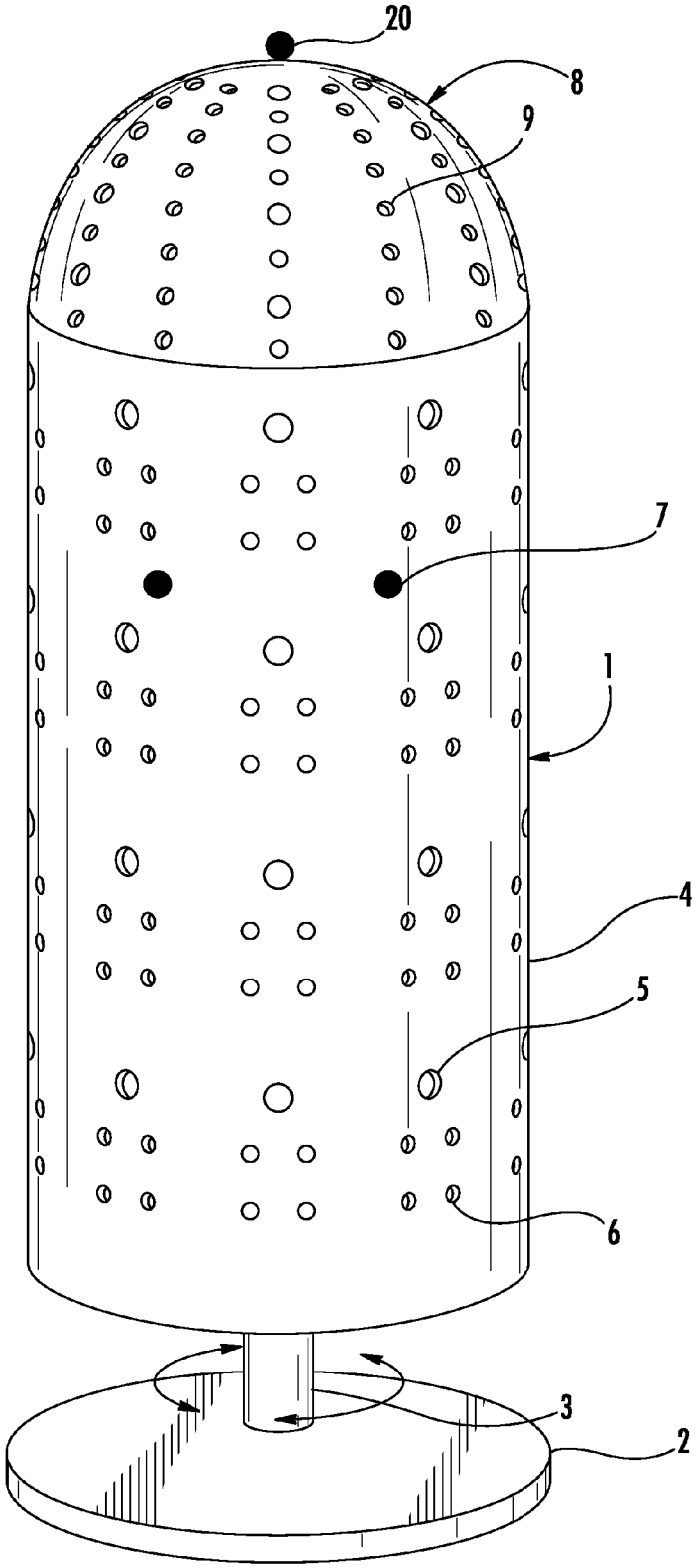
FIG. 1 shows an exemplary embodiment of a rotatable device described herein and optional accessory cap.

FIG. 1 shows an embodiment of a rotatable device 1 as described herein. The device includes a base 2, a column 3, and a housing 4. The housing is configured to rotate about the column in a clockwise and/or counter-clockwise fashion. The base, column, and housing may be constructed out of any suitable materials, including but not limited to plastic, metal, wood, laminate, or carbon fiber sheets. Optionally, the housing is constructed out of a material that includes a color, pattern, design, or the like that is visually pleasing and/or desirable to an individual.

The base is generally constructed to be supported on a horizontal or substantially horizontal surface, such as a floor, tabletop, workbench, etc., depending on the size of the unit and application of use. The column is typically vertical or substantially vertical, and is generally at or substantially at a 90° angle with respect to the base and/or with respect to the floor or other horizontal surface. The base may be of any suitable shape (e.g., circular, oval, oblong, triangular, pyramidal, square, pentagon, hexagon, octagon, etc.), size, width, and weight, to accommodate the weight of the column, housing, interior support structures, and objects that will be suspended on the housing, and suitable for the space in which the device will reside.

The column may be of any suitable shape (e.g., solid or hollow rod, cylinder, polygon cylinder, etc.), size, diameter, and weight, suitable for the size of the unit and objects that will be suspended on the housing. The column may be attached (e.g., with screws, rivets, bolts, etc.) to the base, or the column may fit into a slot or through an opening on the base (e.g., a circular slot or opening into which a cylindrical column fits) and is optionally further attached to the base (e.g. with screws, rivets, bolts, etc.). In some embodiments, the column fits within a vertical or substantially vertical sheath, for example, a hollow tubular member, that is attached at one end to the base. The column may slide into the other end of the sheath (e.g., tubular member) that is not attached to the base. Optionally, a tightening means may be provided to secure the column within the sheath (e.g., tubular member).

The housing is typically in the form of a hollow tube and may be of any suitable shape (e.g., cylinder, polygon cylinder such as triangle, square, pentagon, hexagon, octagon, etc.), size, diameter, thickness, and weight, to accommodate the weight of objects that will be suspended on the housing and suitable for attachment to and rotation about the column. The housing is attached to one or more interior support structure(s) through which the column extends.

The housing contains a plurality of openings (5 and/or 6) that extend through the wall of the housing.

Figure 2:
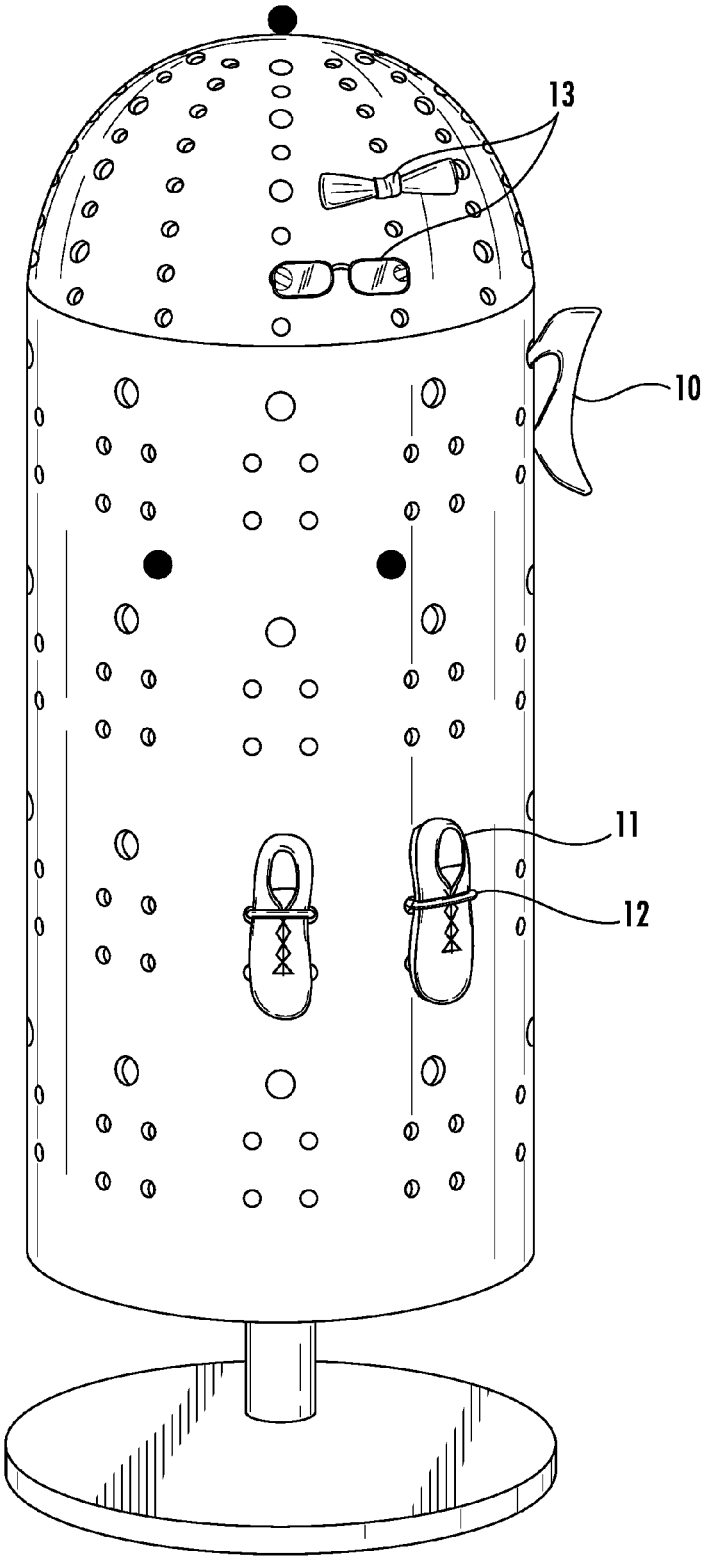
FIG. 2 shows an exemplary embodiment of a rotatable device described herein with shoes displayed and an optional accessory cap with accessories displayed.
Figure 3:
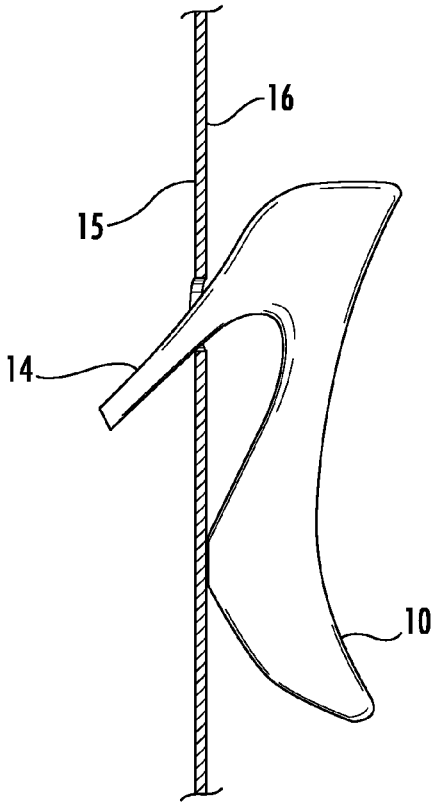
FIG. 3 shows detail of a shoe displayed on a rotatable device or display board with the heel of the shoe extending through an opening in the wall of the device.

In some embodiments, openings 5 are spaced apart and of a dimension sufficient to accommodate the heel of a high heeled shoe (e.g., a women's shoe). As shown in FIG. 2, "high heeled shoes" 10 are suspended on the housing with a portion of the heel extending through opening 5 and the remainder of the shoe suspended on the outside of the housing. As shown in FIG. 3, a portion of heel 14 extends through opening 5, which extends from the outer surface 16 of the housing to the inner surface 15 of the housing, into the interior of the housing. Openings 5 may be of a diameter and shape suitable for a desired dimension of heel 14 to fit through but of a dimension and shape suitable for the remainder of the shoe to remain suspended on the outside of the housing. The openings 5 may be circular or in the shape of an oval or polygon. In some embodiments, the openings include grommets or beveled edges along at least a portion of the interior of the opening. Grommets may be constructed, for example, of rubber or a polymeric material. Openings 5 may be adjusted in shape and size to accommodate objects of interest, for example, tools, household implements, etc.

Figure 4:
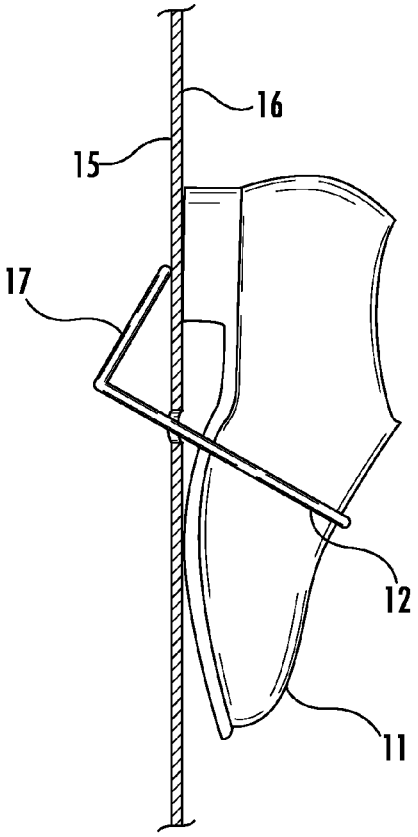
FIG. 4 shows detail of a shoe displayed on a rotatable device or display board with the shoe supported by a bracket that extends through openings in the wall of the device.

In some embodiments, openings 6 are spaced apart and of a dimension sufficient to accommodate ends of brackets that extend through the opening and are attached or anchored to the interior of the housing. As shown in FIG. 2, shoes with short or flat heels 11 slide into and are retained by brackets 12 that protrude from the outside of the housing. As shown in FIG. 4, shoe 11 is slidably suspended on the outside of the housing by bracket 12, which may be anchored at its ends to the interior of the housing. Openings 6 may be adjusted in shape and size to accommodate brackets for holding objects of interest, for example, tools, household implements, etc.

In some embodiments, the housing 4 contains a plurality of openings 5. In other embodiments, the housing 4 contains a plurality of openings 6. In other embodiments, the housing 4 contains a plurality of openings 5 and a plurality of openings 6.

Figure 5:
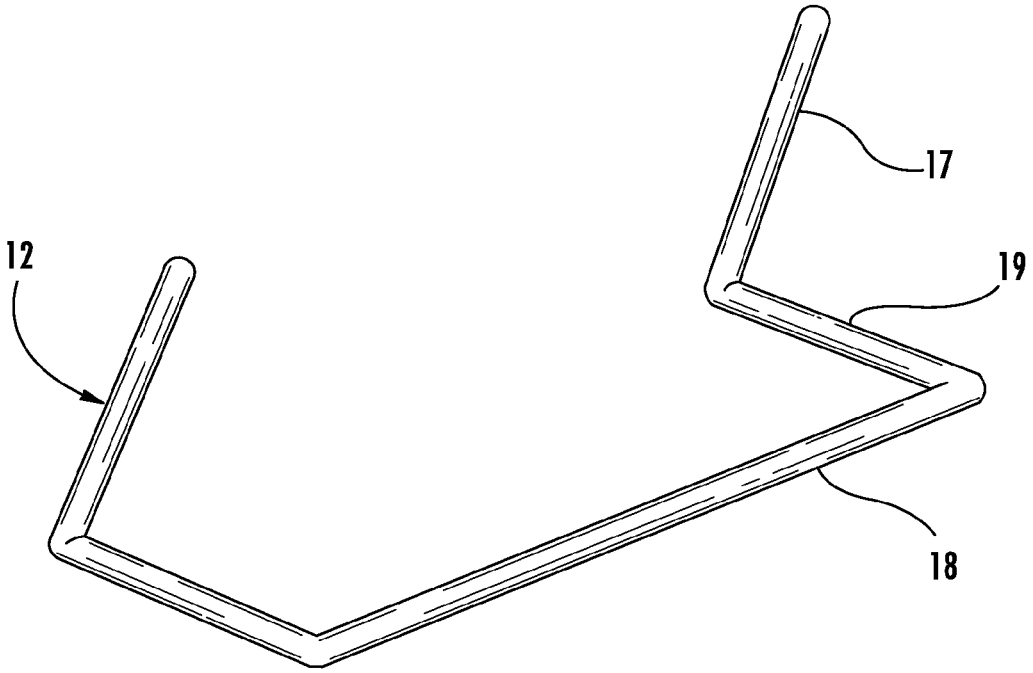
FIG. 5 shows an exemplary embodiment of a bracket for securing shoes, accessories, or other items to a rotatable device as described herein.

An exemplary, but non-limiting, embodiment of a bracket 12 for securing shoes or other objects through openings 6 in a device as described herein is shown in FIG. 5. The bracket includes a width 18 and a depth 19 that are suitable for retaining a object of interest (e.g., a shoe such as a low-heeled shoe or sandal). The bracket also includes a section 17 which anchors the bracket to the interior of the device, as shown in FIG. 4, by downward pressure of the secured object, which holds the end of the bracket against the interior surface of the housing 15. In some embodiments, the angles between sections 17 and 19 and 18 and 19 are right (90°) angles, or at substantially right angles. In some embodiments, the brackets are constructed of metal, plastic or wood.

The device may include a mechanism to facilitate rotation of the housing about the column (e.g., the central axis) of the device. Devices for manual rotation may include, for example, knobs, handles, or the like, which may be fastened to the housing, as depicted in FIG. 1 (7). Other mechanisms for rotation of the housing are also contemplated, such as electrical, battery operated, remote control, etc.

Figure 8:
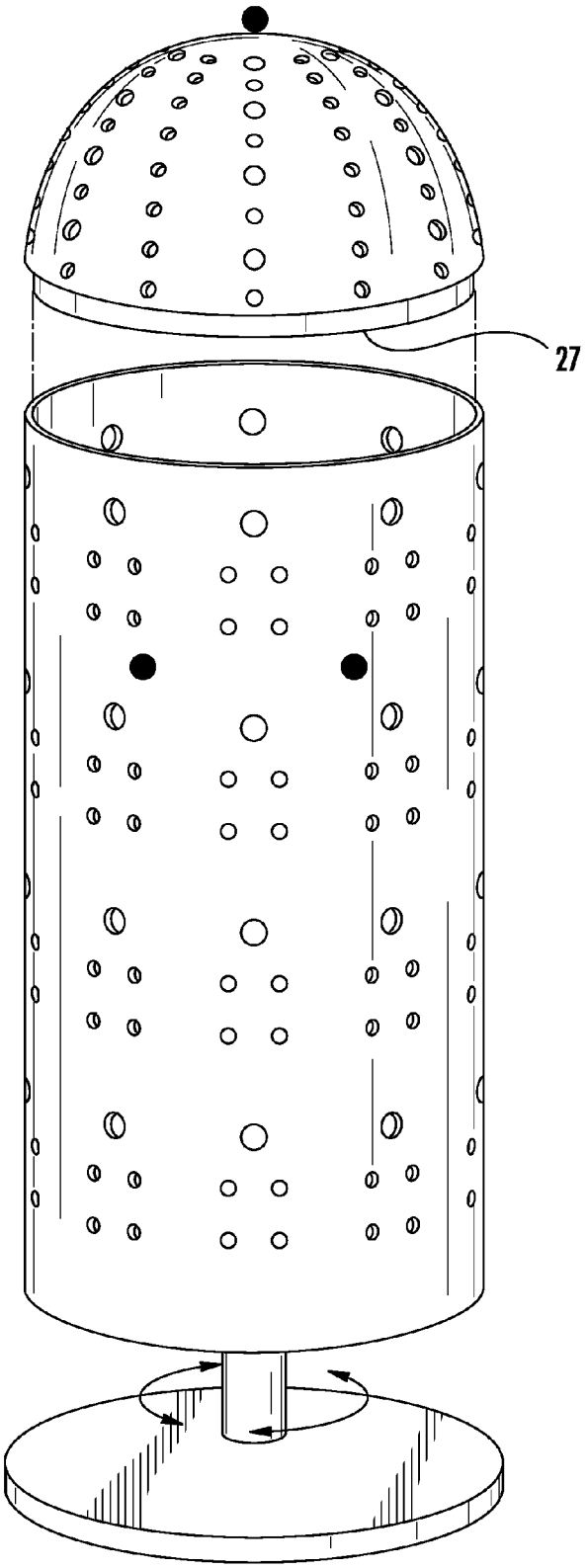
FIG. 8 shows an embodiment of a rotatable device as described herein, with detachable accessory cap.

In certain embodiments, additional openings 9 are provided, in the housing and/or in an extension 8 above or below the housing, for storage and/or display of additional items of interest 13, such as clothing accessories, for example, glasses (e.g., sunglasses), scarves, hats, ties, bowties, belts, collectable miniature shoes, etc. In one embodiment, the extension may be in the form of a hemispherical or substantially hemispherical cap 8, as shown in FIG. 1, although any shape that is suitable for display and/or storage of items of interest is possible. In one embodiment, the extension may be in the form of a hollow tube of the same or different shape and/or interior dimension as the housing. Optionally, the extension 8 may be removable, as shown in FIG. 8. In one embodiment, extension 8 is removable to provide access to an interior shelf inside the housing 4 for storage of items. In some embodiments, openings 9 are spaced apart and of a dimension for a portion of an item of interest to extend through the opening. As shown in FIG. 2, in one embodiment, the openings are spaced apart and of a dimension sufficient to accommodate at least a portion of each temple and/or earpiece of a pair of glasses, such as eyeglasses and/or sunglasses. In some embodiments, openings 9 are spaced apart and of a dimension sufficient to accommodate the ends of brackets (e.g., brackets as shown in FIG. 5) or clips to extend through the opening. Ends of brackets or clips are retained in or fastened to the interior of the housing or extension, with an outer portion on the outside of the housing or extension to retain items of interest, for example, clothing accessories, including but not limited to scarves, jewelry, hats, etc. In one embodiment, a lip 27 may be provided on a top edge of the housing, complementary with a bottom edge of the extension, such that the two edges fit together, with the outer surface of the extension flush with the outer surface of the housing, as shown in FIG. 8. In one embodiment, a knob, handle, or other removal means is provided, shown as 20 in FIG. 1. In one embodiment, an interior disc or disc-like structure, is provided at the top of the housing and underneath the bottom edge of the extension, for interior storage inside the extension. For example, the extension may be removed to insert or remove item(s) from the interior storage shelf.

An extension may be rotatable in conjunction with the housing or may be separately rotatable. In some embodiments, the extension includes a mechanism for rotation about the column (e.g., the central axis) of the device. Devices for manual rotation may include, for example, knobs, handles, or the like, which may be fastened to the extension. Other mechanisms for rotation of the housing are also contemplated, such as electrical, battery operated, remote control, etc.

Figure 6A:
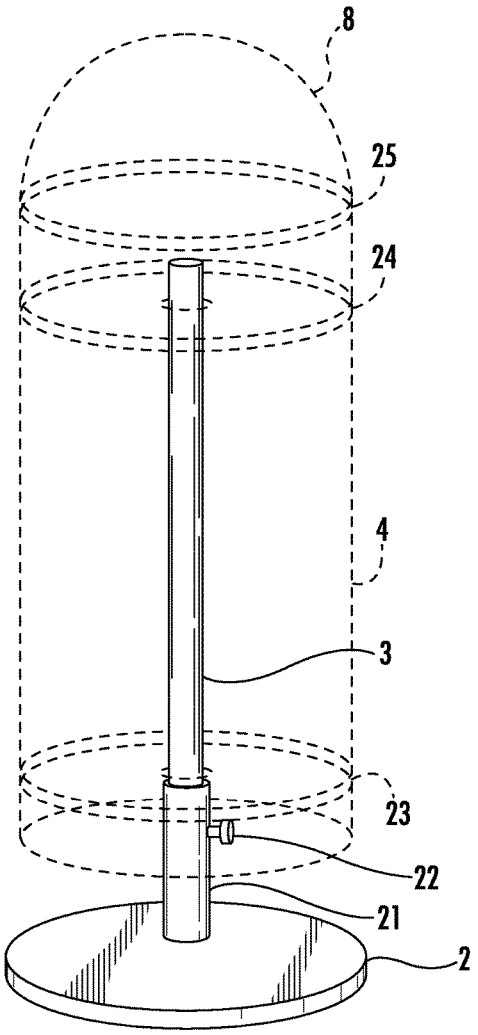
FIG. 6A shows a device with a free-standing base.
Figure 6C:
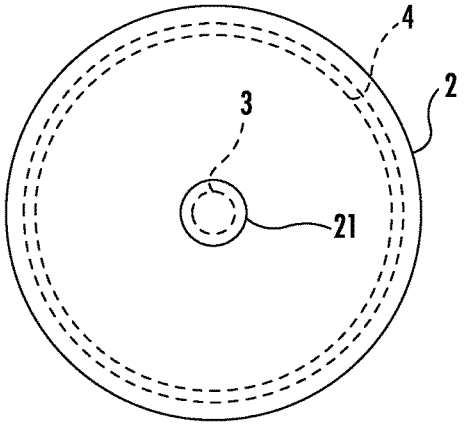
FIG. 6C shows a cross-section of the device.
Figure 6B:
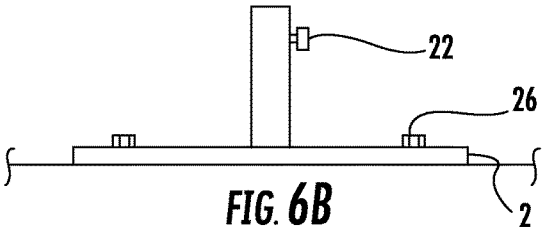
FIG. 6B shows a base that is attached to the floor or other surface.

FIG. 6 shows a rotatable device as described herein. A sheath (e.g., tubular member) 21 is shown attached at one end to the base 2. The column 3 slides into the sheath 21 through the end that is not attached to the base, and may be tightened with a tightening mechanism 22. The housing 4 is shown in dashed lines, as well as interior disc or disc-like structures 23 and 24 (support structures). The column extends through openings in center of the support structure(s). Support structure 23 may be supported on the top of sheath 21, with the diameter of the opening of the support structure 23 smaller than the exterior diameter of the sheath 21. Alternatively, support structure 23 may be supported on bearings that are attached to or supported on the top of sheath 21. Additionally or alternatively, support structure 23 may be secured at its outer periphery to the housing. Optional support structure(s) 24 may be attached at its (their) periphery(ies) to the housing. Optional support structure 24 may be provided as an interior shelf, which is accessible by removal of the extension (e.g., accessory cap) 8. Support structures may be attached to the housing at their outer peripheries, for example, with screws, glue, bolts, rivets, or other suitable attachment means. Optionally, a lip may be provided on a top edge of the housing, complementary with a bottom edge of the extension, such that the two edges fit together, with the outer surface of the extension flush with the outer surface of the housing. This interface between the extension 8 and the housing 4 is shown at 25 in FIG. 6A. FIG. 6A shows a device with a freestanding base. FIG. 6B shows a base that is anchored to the floor or other surface via bolts, screws, or other attachment means 26.

FIG. 6C shows a cross-section of an embodiment of the device, with base 2 of larger diameter than housing 4, and with sheath 21 of larger diameter than column 3.

Figure 7A:
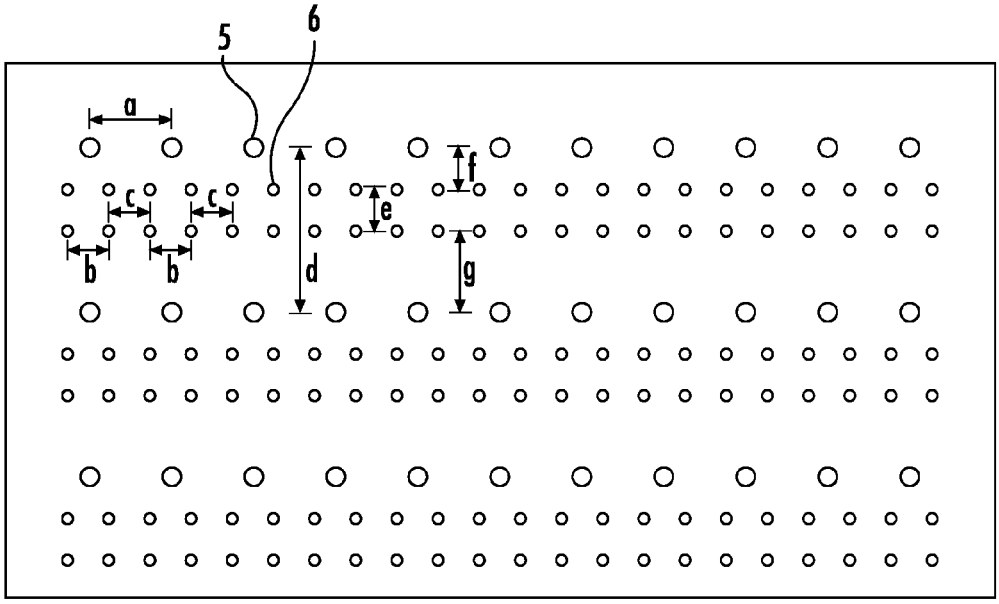
FIG. 7A shows an exemplary detail of the patterning of openings.
Figure 7B:
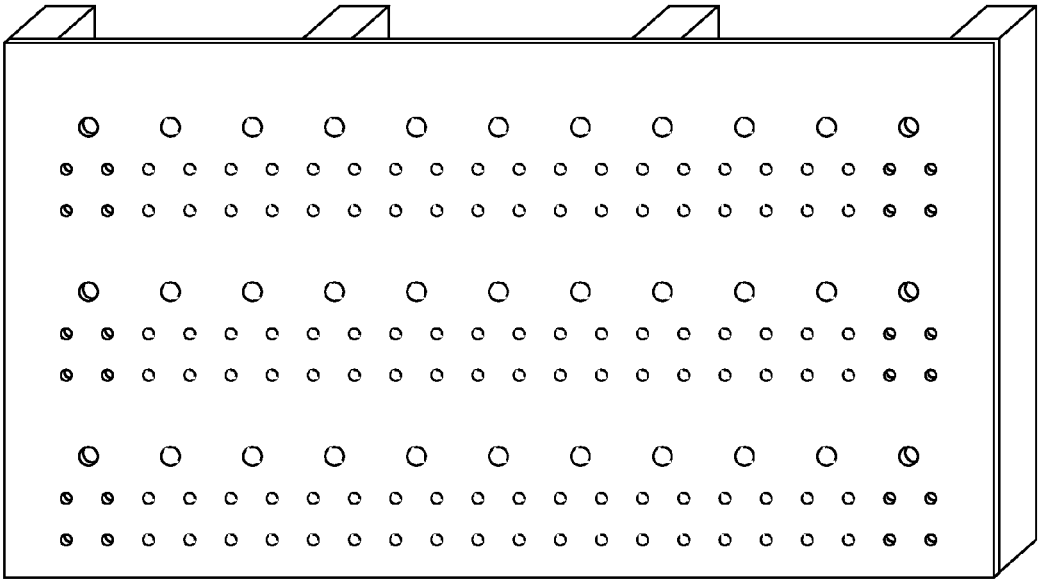
FIG. 7B shows a display board attached to a frame.

FIG. 7A shows an exemplary embodiment of the patterning of openings 5 and 6 on the housing of a rotatable device as described herein or on a display board, optionally attached to a frame, as shown in FIG. 7B. In some embodiments of any of the devices or display boards described herein, the diameter of openings 5 may be about 1 inch (in.) to about 2 in. or 3 in., for example, about 1 in., about 1.5 in., about 2 in., about 2.5 in., or about 3 in. In some embodiments, the horizontal distance "a" between the centers of openings 5 may be about 5 in. to about 7 in., for example, about 5 in., about 5.5 in., about 6 in., about 6.5 in., or about 7 in. In some embodiments of any of the devices or display boards described herein, the diameter of openings 6 may be about ⅛ in. to about ½ in., for example, about ⅛ in., about ¼ in., about ⅜ in., or about ½ in. In some embodiments, the horizontal distance "b" between the centers of openings 6 may be about 4 inches to about 6 inches, for example, about 4 in., about 4.5 in., about 5 in., about 5.5 in., or about 6 in. Horizontal distances "b" and "c" may be the same or different. In some embodiments, horizontal distance "c" is about ½ in. to about 1 in. or about ½ in. to about 3 in., for example, about ½ in., about 1 in., about 1.5 in., about 2 in., about 2.5 in., or about 3 in. In some embodiments, the patterning includes a repeating pattern of one row of openings 5 above two rows of openings 6, as shown schematically in FIG. 7. In some embodiments, the vertical distance "d" between the centers of openings 5 may be about 10 in. to about 15 in., for example, about 10 in., about 11 in., about 12 in., about 13 in., about 14 in., or about 15 in. In some embodiments, the vertical distance "e" between the centers of the openings 6 in adjacent rows may be about 1 in. to about 2 in. or 3 in., for example, about 1 in., about 1.5 in., about 2 in., about 2.5 in., or about 3 in. In some embodiments, the vertical distance "f" between the centers of openings 5 and the centers of openings 6 in the row directly below openings 5 is about 2 in. to about 4 in., for example, about 2 in., about 2.5 in., about 3 in., about 3.5 in., or about 4 in. In some embodiments, the vertical distance "g" between the centers of openings 6 and the centers of openings 5 in the adjacent row of openings 5 above is the same or different than distance "f." In some embodiments, the vertical distance "g" is about 6 in. to about 9 in., for example, about 6 in., about 6.5 in., about 7 in., about 7.5 in., about 8 in., about 8.5 in., or about 9 in.

The patterning shown schematically in FIG. 7 and described above may be incorporated into the housing of a rotatable device as described herein or may be incorporated into a display board that may be affixed to a wall or other surface, or mounted on a frame, as shown in FIG. 7B. The patterning may also be varied. For example, the patterning may include alternating rows of openings 5 and 6, one row of openings 5 with two or more rows of openings 6 between openings 5, etc., depending on the types and varieties of objects (e.g., shoes) to be displayed. The distances exemplified in FIG. 7 may also be varied, to accommodate the types and varieties of objects (e.g., shoes) to be displayed.

Although the foregoing invention has been described in some detail by way of illustration and examples for purposes of clarity of understanding, it will be apparent to those skilled in the art that certain changes and modifications may be practiced without departing from the spirit and scope of the invention, which is delineated in the appended claims. Therefore, the description should not be construed as limiting the scope of the invention.

All publications, patents, and patent applications cited herein are hereby incorporated by reference in their entireties for all purposes and to the same extent as if each individual publication, patent, or patent application were specifically and individually indicated to be so incorporated by reference.

I claim:

1. A rotatable shoe display and storage device, comprising:

(a) a base;

(b) a vertical column supported on the base;

(c) a housing that is rotatably disposed about the column, wherein the housing comprises an outer surface that faces the outside of the housing and an inner surface that faces the inside of the housing;

(d) a plurality of openings that extend from the outer surface to the inner surface of the housing; and (e) a shoe, wherein (i) the shoe comprises a heel of a length sufficient to extend through the openings that extend from the outer surface to the inner surface of the housing, wherein said plurality of openings are spaced apart and of a dimension sufficient to accommodate at least a portion of said heel to extend therethrough, and wherein said shoe is retained on the housing in a vertical or substantially vertical orientation with at least a portion of said heel extending through one of said openings beyond the inner surface into the interior of the housing and at least a portion of the bottom of the shoe is in contact with the outer surface of the housing, or (ii) the shoe does not comprise a heel that extends through the openings that extend from the outer surface to the inner surface of the housing, and wherein the shoe comprises a width, a depth, and a weight, wherein the device comprises a bracket that comprises two first sections that comprise the ends of the brackets, two second sections that are contiguous with the first sections and at angles of about 90° with respect to the first sections and comprising lengths suitable for retaining the depth of the shoe, and one third section contiguous at each end with the second sections and at angles of about 90° with respect to the second sections and comprising a length suitable for retaining the width of the shoe, wherein said plurality of openings are spaced apart and of a dimension sufficient to accommodate said ends of the first sections of the bracket to extend therethrough, wherein the ends of the first sections of the bracket are inserted into the openings that extend from the outer surface to the inner surface of the housing and are held against the inner wall of the device by downward pressure exerted by the weight of the shoe, thereby anchoring the bracket on the inner surface of the housing, wherein the second and third sections of the bracket protrude from the outer surface of the wall of the housing and are of dimensions sufficient to slidably accommodate said shoe without permitting the shoe to slide completely through the bracket, and wherein said shoe is retained by said bracket on the outer surface of the housing in a vertical or substantially vertical orientation.

2. A device according to claim 1, further comprising a sheath that is interior to the housing, which comprises a proximal end that is attached to the base and a distal end that extends vertically a first portion of the height of the housing, and which comprises an interior diameter that is greater than the exterior diameter of the column, wherein the column comprises a proximal end that is inserted into the sheath and a distal end that extends vertically a second portion of the height of the housing, wherein the second height is greater than the first height.

3. A device according to claim 2, further comprising a structural member that is interior to the housing and which comprises an opening through which the column extends, wherein the diameter of the opening in the structural member is smaller than the exterior diameter of the sheath, wherein the structural member rests on top of the distal end of the sheath, and wherein the structural member is attached to the housing at the periphery of the structural member.

4. A device according to claim 3, wherein the structural member comprises a disc with said opening through which the column extends in the center of the disc.

5. A device according to claim 1, further comprising grommets around the openings on the inner surface of the housing.

6. A device according to claim 1, further comprising a mechanism to facilitate rotating the housing by hand.

7. A device according to claim 6, wherein the mechanism comprises knobs or handles on the outer surface of the housing.

8. A device according to claim 1, further comprising an extension that is located above the housing, wherein the extension is attached to and rotatably disposed about the column or is slidably inserted into the top of the housing, wherein the extension comprises an outer surface that faces the outside of the extension and an inner surface that faces the inside of the extension, and wherein the extension comprises a plurality of openings that extend from the outer surface to the inner surface of the extension.

9. A device according to claim 8, wherein the extension comprises a hemispherical or essentially hemispherical cap above the housing.

10. A device according to claim 8, wherein the openings in the extension are spaced apart and of a dimension sufficient to accommodate an accessory that is adapted to extend therethrough, wherein a portion of the accessory is adapted to extend beyond the inner surface into the interior of the extension.

11. A device according to claim 10, wherein the openings are spaced apart and of a dimension adapted to accommodate at least a portion of a temple or earpiece of a pair of eyeglasses or sunglasses.

12. A device according to claim 8, wherein the openings that extend from the outer surface to the inner surface of the extension are spaced apart and of a dimension adapted to accommodate ends of brackets or clips that are adapted to extend therethrough and that are adapted to retain accessories on the outer surface of the extension.

13. A device according to claim 12, further comprising brackets or clips that are adapted to retain accessories comprising hats, jewelry, ties, bowties, scarves, or miniature shoes.

14. A device according to claim 8, wherein the shoe storage device and the extension are separately rotatable.

15. A device according to claim 14, wherein the extension further comprises a mechanism to facilitate rotating the extension by hand.

16. A device according to claim 15, wherein the mechanism comprises knobs or handles on the outer surface of the extension.

17. A device according to claim 8, wherein the shoe storage device and the extension are not separately rotatable.

18. A bracket that is adapted to retain a shoe against a device having an outer wall, an inner wall, and a plurality of openings that extend from the outer surface to the inner surface of the device, and a shoe that is retained by the bracket, wherein the shoe comprises a width, a depth, and a weight, wherein the bracket consists of two first sections that define the ends of the brackets, two second sections contiguous with the first sections and at angles of about 90° with respect to the first sections and comprising lengths suitable for retaining the depth of the shoe, and one third section contiguous at each end with the second sections and at angles of about 90° with respect to the second sections and comprising a length suitable for retaining the width of the shoe, wherein the first sections comprise a length suitable for holding the shoe in a vertical or substantially vertical orientation against the outer wall of the device, wherein when the first sections are inserted into the openings in the device, the ends of the first sections are adapted to be held against the inner wall of the device by downward pressure exerted by the weight of the shoe.

19. A display board comprising an outer surface and an inner surface, wherein the display board comprises a horizontal or substantially horizontal row of first openings comprising a first diameter and at least one horizontal or substantially horizontal row of second openings comprising a second diameter below or above the row of first openings, wherein the first diameter is larger than the second diameter; and further comprising a shoe, wherein (i) the shoe comprises a heel of a length sufficient to extend through the first openings that extend from the outer surface to the inner surface of the display board, wherein said first openings are spaced apart and of a dimension sufficient to accommodate at least a portion of said heel to extend therethrough, and wherein said shoe is retained on the housing in a vertical or substantially vertical orientation with at least a portion of said heel extending through one of said openings beyond the inner surface of the display board and at least a portion of the bottom of the shoe in contact with the outer surface of the display board, or (ii) the shoe does not comprise a heel that extends through the openings that extend from the outer surface to the inner surface of the display board, and wherein the shoe comprises a width, a depth, and a weight, wherein the device comprises a bracket that comprises two first sections that comprise the ends of the brackets, two second sections that are contiguous with the first sections and at angles of about 90° with respect to the first sections and comprising lengths suitable for retaining the depth of the shoe, and one third section contiguous at each end with the second sections and at angles of about 90° with respect to the second sections and comprising a length suitable for retaining the width of the shoe, wherein said second openings are spaced apart and of a dimension sufficient to accommodate said ends of the first sections of the bracket to extend therethrough, wherein the ends of the first sections of the bracket are inserted into the second openings and are held against the inner surface of the display board by downward pressure exerted by the weight of the shoe, thereby anchoring the bracket on the inner surface of the display board, wherein the second and third sections of the bracket protrude from the outer surface of the display board and are of dimensions sufficient to slidably accommodate said shoe without permitting the shoe to slide completely through the bracket, and wherein said shoe is retained by said bracket on the outer surface of the display board in a vertical or substantially vertical orientation.

20. A display board according to claim 19, wherein the display board comprises two rows of second openings below or above the row of first openings.

21. A display board according to claim 19, comprising a plurality of rows of first openings, wherein the board comprises an alternating pattern of rows of first openings and two rows of second openings.

22. A display board according to claim 19, wherein the board is mounted on a frame that is adapted to be affixed to a wall.

* * * * *